US010334365B2

(12) United States Patent
Iwamoto et al.

(10) Patent No.: US 10,334,365 B2
(45) Date of Patent: Jun. 25, 2019

(54) ACOUSTIC PROCESSING DEVICE

(71) Applicant: YAMAHA CORPORATION, Hamamatsu-shi (JP)

(72) Inventors: Kenji Iwamoto, Iwata (JP); Satsuki Kawahashi, Hamamatsu (JP); Koichi Ishizaki, Hamamatsu (JP); Ryuichiro Kuroki, Hamamatsu (JP); Naoyuki Onozawa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/912,748

(22) Filed: Mar. 6, 2018

(65) Prior Publication Data

US 2018/0279047 A1 Sep. 27, 2018

(30) Foreign Application Priority Data

Mar. 22, 2017 (JP) ..... 2017-055299

(51) Int. Cl.

| | |
|---|---|
| ***H04R 5/02*** | (2006.01) |
| ***H04R 5/04*** | (2006.01) |
| *H04R 1/02* | (2006.01) |
| *G10H 3/18* | (2006.01) |

(52) U.S. Cl.

CPC ..... *H04R 5/02* (2013.01); *H04R 5/04* (2013.01); *G10H 3/186* (2013.01); *H04R 1/02* (2013.01); *H04R 1/026* (2013.01); *H04R 2420/07* (2013.01)

(58) Field of Classification Search

CPC ..... H04R 5/02; H04R 1/02; H04R 5/04

See application file for complete search history.

(56) References Cited

U.S. PATENT DOCUMENTS

| | | | | |
|---|---|---|---|---|
| 6,527,237 | B2 * | 3/2003 | Harary | H04R 1/026 181/141 |
| 7,995,783 | B2 * | 8/2011 | Ledbetter | H04R 1/1016 381/374 |
| 8,483,414 | B2 * | 7/2013 | Kondo | H04R 3/12 348/738 |
| 2007/0274547 | A1 | 11/2007 | Ueno | |
| 2009/0285438 | A1 | 11/2009 | Liou et al. | |
| 2009/0304186 | A1 | 12/2009 | Katayama et al. | |
| 2013/0301861 | A1 * | 11/2013 | Ho | H04R 1/023 381/332 |
| 2015/0125019 | A1 * | 5/2015 | Porter | H04R 1/026 381/333 |

(Continued)

FOREIGN PATENT DOCUMENTS

| | | |
|---|---|---|
| CN | 2904535 Y | 5/2007 |
| EP | 2180718 A1 | 4/2010 |

(Continued)

OTHER PUBLICATIONS

Partial European Search Report issued in European Appln. No. 18161373.8 dated Aug. 10, 2018.

(Continued)

*Primary Examiner* — Andrew L Sniezek

(74) *Attorney, Agent, or Firm* — Rossi, Kimms & McDowell LLP

(57) ABSTRACT

An acoustic processing device includes: a plurality of loudspeaker units that output sound; and a mechanism that is configured to be capable of changing a distance between the loudspeaker units.

8 Claims, 5 Drawing Sheets

(56) References Cited

U.S. PATENT DOCUMENTS

| | | | | |
|---|---|---|---|---|
| 2016/0255435 | A1* | 9/2016 | Johnson | H01R 13/703 381/74 |
| 2017/0164078 | A1* | 6/2017 | Yoon | H04R 1/025 |
| 2018/0288509 | A1* | 10/2018 | Yan | H04R 3/00 |

FOREIGN PATENT DOCUMENTS

| | | | |
|---|---|---|---|
| JP | 2008244932 | A | 10/2008 |
| JP | 5206137 | B2 | 6/2013 |

OTHER PUBLICATIONS

Office Action issued in Japanese Appln. No. 2017-055299 dated Jan. 29, 2019. English machine translation provided.

* cited by examiner

ACOUSTIC PROCESSING DEVICE

CROSS-REFERENCE TO RELATED APPLICATION

Priority is claimed on Japanese Patent Application No. 2017-055299, filed Mar. 22, 2017, the content of which is incorporated herein by reference.

BACKGROUND OF THE INVENTION

Field of the Invention

The present invention relates to an acoustic processing device.

Description of Related Art

In recent years, acoustic processing devices such as guitar amplifier loudspeakers have become known. In such an acoustic processing device, an acoustic processing unit and a loudspeaker unit are included, and acoustic processing for applying an acoustic effect to input sound data is performed by the acoustic processing unit and resultant sound data is output from the loudspeaker unit. Further, a technology for widening a sound field in a pseudo manner without impairing a sensation of sound localization with loudspeakers disposed with a narrow interval therebetween is known (see, for example, Japanese Patent No. 5206137 (hereinafter referred to as Patent Document 1)).

SUMMARY OF THE INVENTION

However, in the acoustic processing device described above, for example, when the acoustic processing unit such as a guitar amplifier loudspeaker and the loudspeaker unit are integrally configured, a layout of the loudspeaker units is fixed at a narrow interval, and the sensation of sound localization and the spread of the sound field cannot be obtained in some cases. Further, in the technology for widening a sound field in a pseudo manner described in Patent Document 1, there is a possibility of the sensation of sound localization and the spread of the sound field being insufficient.

The present invention has been made to solve the above problems. An exemplary object of the present invention is to provide an acoustic processing device capable of suitably obtaining a sensation of sound localization and a spread of a sound field.

An acoustic processing device according to an aspect of the present invention includes: a plurality of loudspeaker units that output sound; and a mechanism that is configured to be capable of changing a distance between the loudspeaker units.

An acoustic processing device according to an aspect of the present invention includes: an electrical component unit and a plurality of loudspeaker units. The electrical component unit includes an acoustic processing unit, an output unit, and an operation unit. The acoustic processing unit executes acoustic processing on input sound data. The output unit outputs the sound data on which the acoustic processing is executed. The operation unit receives an operation on the acoustic processing unit. The electrical component unit is configured to be detachable. The loudspeaker units output sound generated based on the sound data on which the acoustic processing is executed.

According to the present invention, it is possible to suitably obtain a sensation of sound localization and a spread of a sound field.

DETAILED DESCRIPTION OF THE INVENTION

Hereinafter, an acoustic processing device according to embodiments of the present invention will be described with reference to the drawings.

First Embodiment

Figure 1A:
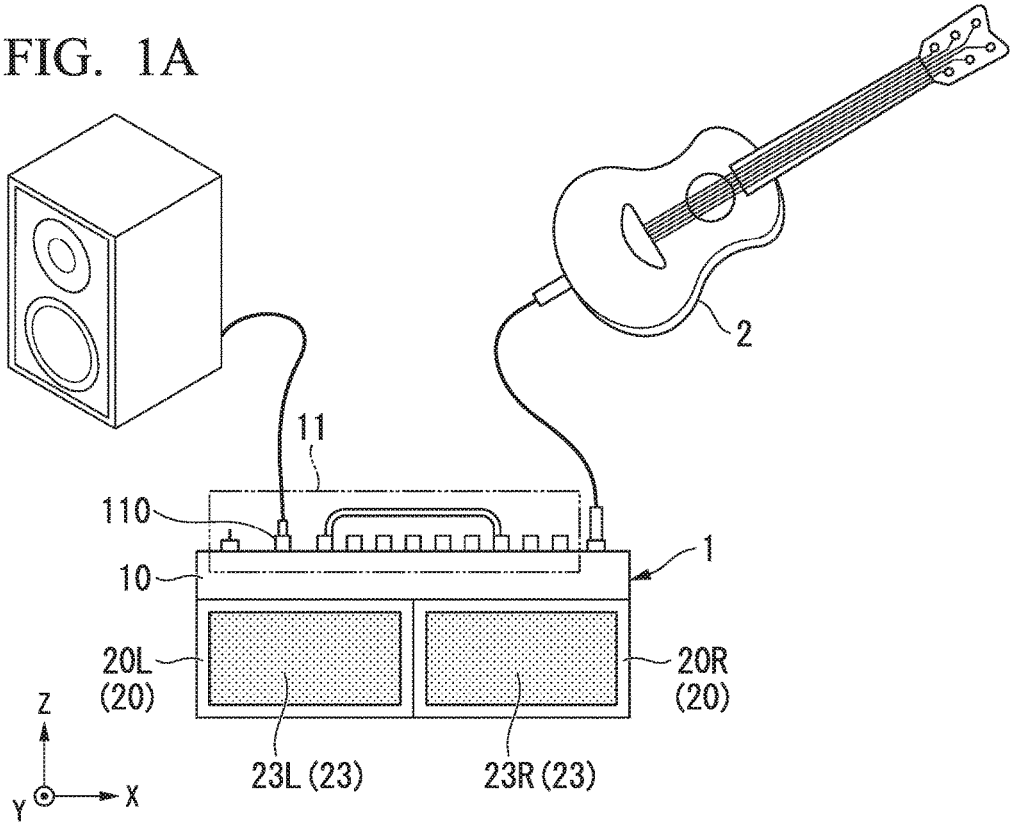
FIG. 1A is a configuration diagram illustrating an example of an acoustic processing device according to a first embodiment.
Figure 1B:
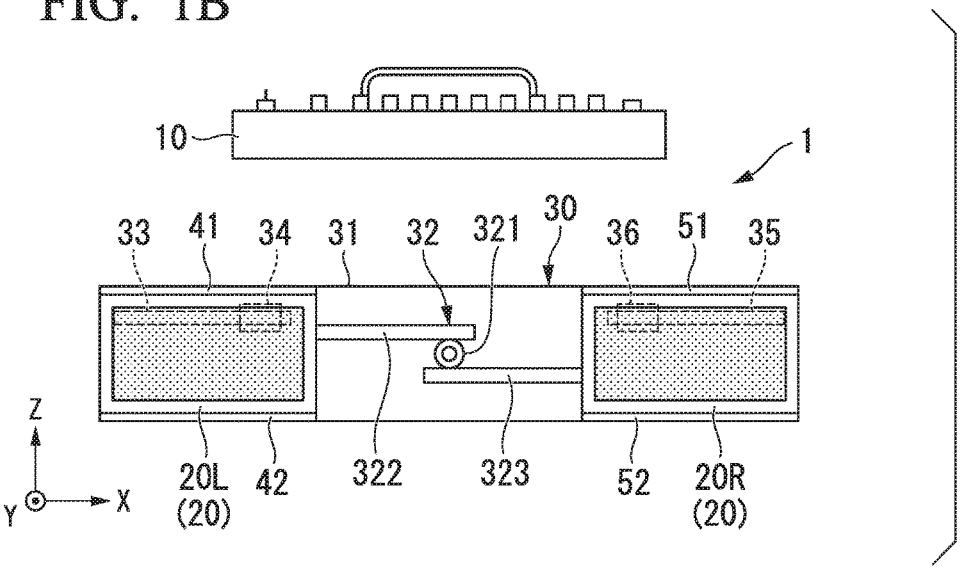
FIG. 1B is a configuration diagram illustrating the example of the acoustic processing device according to the first embodiment.
Figure 2:
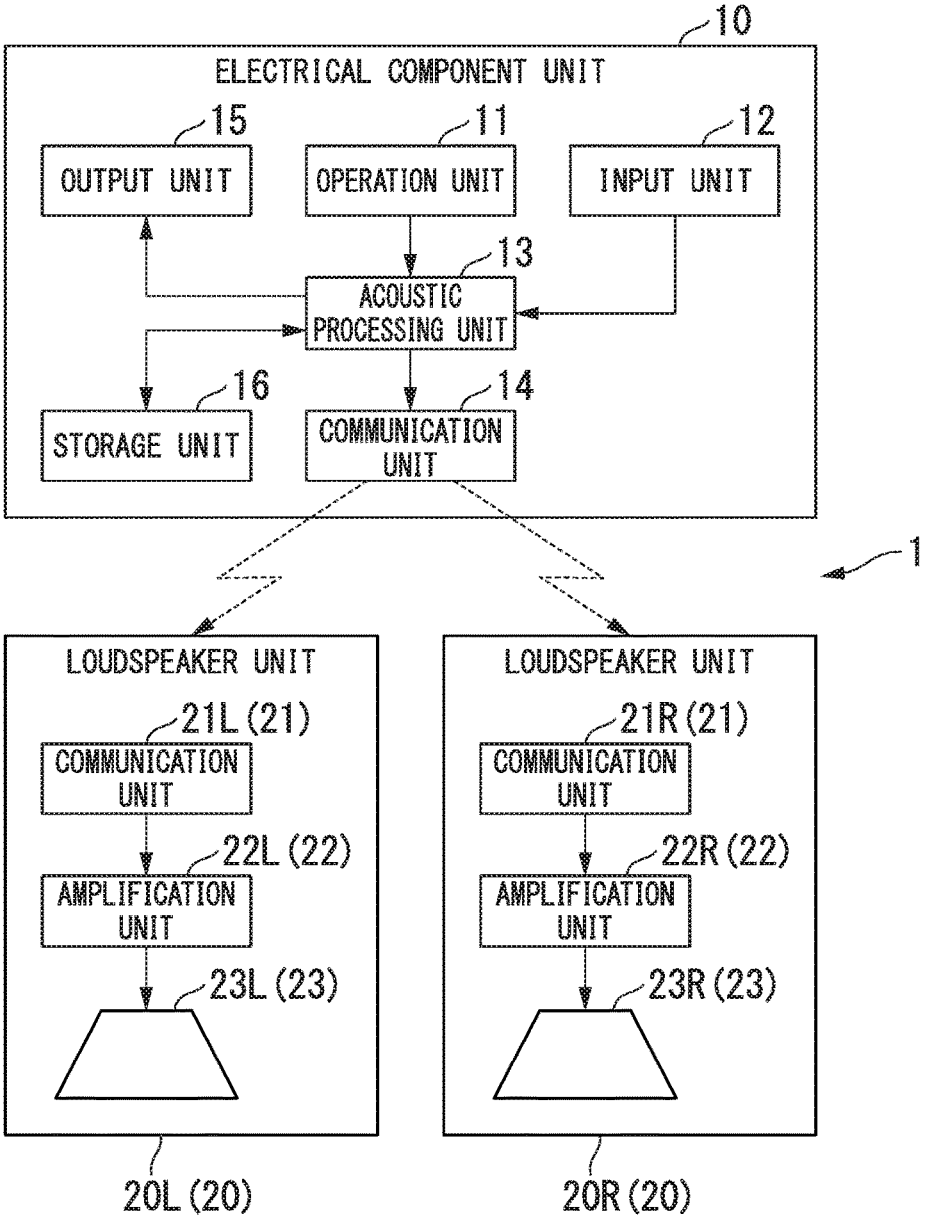
FIG. 2 is a functional block diagram illustrating an example of the acoustic processing device according to the first embodiment.

FIGS. 1A and 1B are configuration diagrams illustrating an example of an acoustic processing device 1 according to a first embodiment. FIG. 2 is a functional block diagram illustrating an example of the acoustic processing device 1 according to the embodiment.

As illustrated in FIGS. 1A and 1B and FIG. 2, the acoustic processing device 1 includes an electrical component unit 10 and loudspeaker units (20L and 20R). The acoustic processing device 1 is, for example, a portable guitar amplifier loudspeaker, and functions as a multi-effector. The acoustic processing device 1 receives a performance of the guitar 2, executes acoustic processing for applying an acoustic effect for an input sound and outputs (emits) the sound subjected to acoustic processing from the loudspeaker units (20L, 20R).

Further, in the acoustic processing device 1, the electrical component unit 10 is configured to be detachable, and each of the loudspeaker units (20L, 20R) is configured to be separable. FIG. 1A illustrates an external view of the acoustic processing device 1 in a case in which the electrical component unit 10 and the loudspeaker units (20L, 20R) are not separated from each other. FIG. 1B illustrates a configuration example of the acoustic processing device 1 in a case in which the electrical component unit 10 and the loudspeaker units (20L, 20R) are separated from each other (in a case in which the electrical component unit 10 is detached from the loudspeaker units (20L, 20R)). Details of the configuration in which the electrical component unit 10 and the loudspeaker units (20L, 20R) are separated from each other will be described below.

Note that, in the following description, it is assumed that a longitudinal direction of a sound emission surface of the loudspeaker unit (20L, 20R) of the acoustic processing device 1 is an X-axis direction, a depth direction orthogonal to the longitudinal direction of the acoustic processing device 1 is a Y-axis direction, and a height direction of the acoustic processing device 1 is a Z-axis direction.

The electrical component unit 10 includes an operation unit 11, an input unit 12, an acoustic processing unit 13, a communication unit 14, an output unit 15, and a storage unit 16, executes, for example, various types of acoustic processing for an input sound, and functions as, for example, a multi-effector. The electrical component unit 10 can be used in cooperation with the loudspeaker units (20L, 20R) via the communication unit 14 and can also be used alone without cooperation with the loudspeaker units (20L, 20R) by using the output unit 15.

The operation unit 11 is, for example, a switch or an operation knob for receiving various operations of the acoustic processing device 1. The operation unit 11 may include an output terminal 110 such as a line out terminal or a line out jack. The output terminal 110 output to an external device such as an external loudspeaker 5, the sound data on which the acoustic processing is executed. The input unit 12 includes, for example, an analog to digital converter (ADC), receives a sound signal from the guitar 2, converts the sound signal into sound data, and supplies the sound data to the acoustic processing unit 13.

The acoustic processing unit 13 is, for example, a processor such as a digital signal processor (DSP), and executes acoustic processing of applying a sound effect to the sound data input from the input unit 12. Here, the acoustic processing is, for example, various types of effect processing such as those of a compressor, an equalizer (EQ), and a delay, or processing for applying various effects such as pitch shifting, time stretching, and band extension. Further, the acoustic processing also includes so-called bypass processing for passing sound data without performing any processing on the sound data. The acoustic processing unit 13 executes, for example, acoustic processing based on various operations using the operation unit 11 and outputs the sound data subjected to the acoustic processing to the communication unit 14 or the output unit 15. Further, the acoustic processing unit 13 may store setting information of the acoustic processing in the storage unit 16 to be described below or acquire the setting information from the storage unit 16.

The communication unit 14 transmits the sound data subjected to acoustic processing by the acoustic processing unit 13 to the loudspeaker units (20L, 20R) through wireless communication such as Bluetooth (registered trademark) or infrared communication to cause sound based on the sound data transmitted to the loudspeaker units (20L, 20R) to be output.

The output unit 15 is, for example, a line output unit and outputs a sound signal based on the sound data subjected to acoustic processing by the acoustic processing unit 13.

The storage unit 16 stores information that is used for various types of processing of the acoustic processing device 1. The storage unit 16 stores, for example, acoustic processing setting information.

The loudspeaker unit 20L is, for example, an L channel loudspeaker device and the loudspeaker unit 20R is, for example, an R channel loudspeaker device. The loudspeaker unit 20L includes a communication unit 21L, an amplification unit 22L, and a loudspeaker 23L. Further, the loudspeaker unit 20R includes a communication unit 21R, an amplification unit 22R, and a loudspeaker 23R.

Note that the loudspeaker unit 20L and the loudspeaker unit 20R have the same configuration and will be described as a loudspeaker unit 20 when any loudspeaker unit included in the acoustic processing device 1 is indicated or when the loudspeaker unit 20L and the loudspeaker unit 20R are not being particularly distinguished from each other. Further, the communication unit 21L and the communication unit 21R, the amplification unit 22L and the amplification unit 22R, and the loudspeaker 23L and the loudspeaker 23R will be similarly described as a communication unit 21, an amplification unit 22, and a loudspeaker 23 when any of these configurational components included in the acoustic processing device 1 is indicated or when the communication unit 21L and the communication unit 21R, the amplification unit 22L and the amplification unit 22R, and the loudspeaker 23L and the loudspeaker 23R are not being particularly distinguished from each other.

The communication unit 21 receives the sound data subjected to the acoustic processing by the acoustic processing unit 13 through the same wireless communication as the above-described communication unit 14. The communication unit 21 outputs the received sound data to the amplification unit 22.

The amplification unit 22 is, for example, an amplifier with a digital to analog converter (DAC) and outputs a sound signal obtained by converting and amplifying the acquired sound data to the loudspeaker 23 to cause sound to be output from the loudspeaker 23.

The loudspeaker 23 converts the sound signal output from the amplification unit 22 into a sound and outputs (emits) the sound.

Further, as illustrated in FIG. 1B, the acoustic processing device 1 includes a separation mechanism 30 configured to be able to move relative positions between a plurality of (for example, two) the loudspeaker units 20. Here, the relative position is a position relative to the other loudspeaker unit 20. For example, when there are two loudspeaker units 20, the relative position indicates a relative position between the two loudspeaker units 20.

In the acoustic processing device 1, the electrical component unit 10 is configured to be detachable, and the loudspeaker unit 20L and the loudspeaker unit 20R after the electrical component unit 10 has been separated therefrom are separated by the separation mechanism 30.

The separation mechanism 30 separates and moves the two loudspeaker units 20 (20L, 20R) in the longitudinal direction (an X-axis direction) of the acoustic processing device 1 to change a layout of the two loudspeaker units 20. The separation mechanism 30 includes a back panel 31, a rack and pinion mechanism 32, guide rails (33, 35), support members (34, 36), upper plates (41, 51), and lower plates (42, 52). That is, separation mechanism (mechanism) 30 is configured to be capable of changing a distance between the two loudspeaker units 20 (20L, 20R).

The back panel 31 is a plate disposed on a back surface of the two loudspeaker units 20, fixes the rack and pinion mechanism 32, and fixes the support members (34, 36).

The rack and pinion mechanism 32 moves the two loudspeaker units 20 in the longitudinal direction (the X-axis direction) of the acoustic processing device 1 to uniformly separate the two loudspeaker units 20 from a longitudinal center of the acoustic processing device 1. The rack and pinion mechanism 32 includes a pinion portion 321 and rack portions (322, 323).

The pinion portion 321 is a circular gear, and the circular gear is rotatably installed on the back panel 31. The pinion portion 321 is disposed so that teeth of the rack portions (322, 323) to be described below mesh with teeth of the gear. When the pinion portion 321 rotates, the rack portions (322, 323) are moved in the longitudinal direction (the X-axis direction) of the acoustic processing device 1.

The rack portions (322, 323) are flat plate-like bars with teeth that mesh with teeth of the gear of the pinion portion 321. The rack portions (322, 323) are disposed parallel to the longitudinal direction (the X-axis direction) of the acoustic processing device 1 and are moved uniformly from a center in the longitudinal direction as the pinion portion 321 rotates. The rack portion 322 is connected to the back surface of the loudspeaker unit 20L, and the rack portion 322 moves in the longitudinal direction (the X-axis direction) to move the loudspeaker unit 20L. Further, the rack portion 323 is connected to the back surface of the loudspeaker unit 20R, and the rack portion 323 moves in the longitudinal direction (the X-axis direction) to move the loudspeaker unit 20R. Here, the back surface of the loudspeaker unit 20L and the back surface of the loudspeaker unit 20R are surfaces opposite to the sound emission surface.

A guide rail 33 is installed on the back surface of the loudspeaker unit 20L and linearly moves the support member 34 along a shape of the rail (the guide rail 33), thereby linearly moving the loudspeaker unit 20L in a longitudinal direction (the X-axis direction). Further, a guide rail 35 is installed on a back surface of the loudspeaker unit 20R and linearly moves the support member 36 along a shape of the rail (the guide rail 35), thereby linearly moving the loudspeaker unit 20R in the longitudinal direction (the X-axis direction). That is, the guide rail 33 has a shape of extending in the predetermined direction (longitudinal direction of the acoustic processing device 1), and supports the movement of the support member 36 along the predetermined direction.

The support member 34 is connected to the back panel 31 and supports the loudspeaker unit 20L.

The support member 34 moves along the guide rail 33 to linearly move the loudspeaker unit 20L. Further, the support member 36 is connected to the back panel 31 and supports the loudspeaker unit 20R. The support member 36 moves along the guide rail 35 to linearly move the loudspeaker unit 20R.

An upper plate 41 and a lower plate 42 are disposed to sandwich the loudspeaker unit 20L vertically, and hold the loudspeaker unit 20L by sandwiching the loudspeaker unit 20L vertically. Further, an upper plate 51 and a lower plate 52 are disposed to sandwich the loudspeaker unit 20R vertically and hold the loudspeaker unit 20R by sandwiching the loudspeaker unit 20R vertically.

Note that the upper plate 41 and the lower plate 42 are included in a rotation mechanism 40 that changes an orientation (a sound emission direction) of the loudspeaker unit 20L, and the upper plate 51 and the lower plate 52 are included in a rotation mechanism 50 that changes an orientation (the sound emission direction) of the loudspeaker unit 20R.

Next, details and an operation of the separation mechanism 30 and the rotation mechanism (40, 50) according to the embodiment will be described with reference to FIGS. 3A to 3C.

Figure 3A:
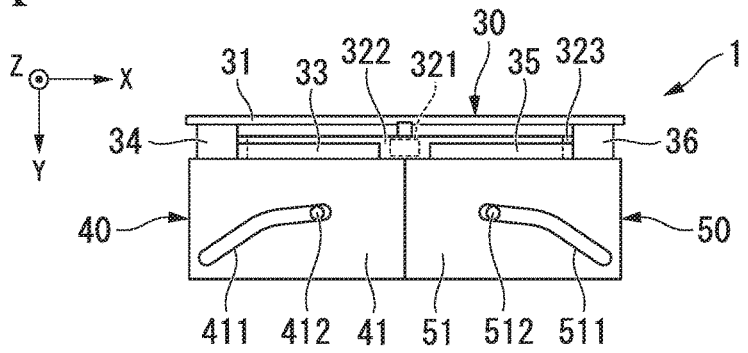
FIG. 3A is a diagram illustrating an example of a separation mechanism and a rotation mechanism in the first embodiment.
Figure 3B:
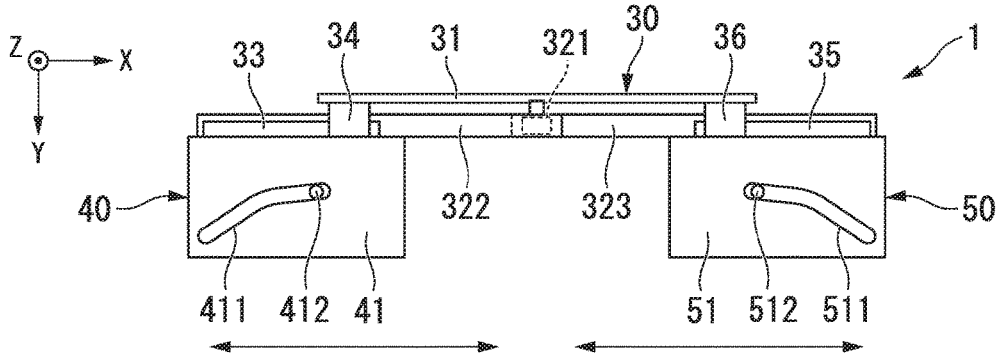
FIG. 3B is a diagram illustrating the example of the separation mechanism and the rotation mechanism in the first embodiment.
Figure 3C:
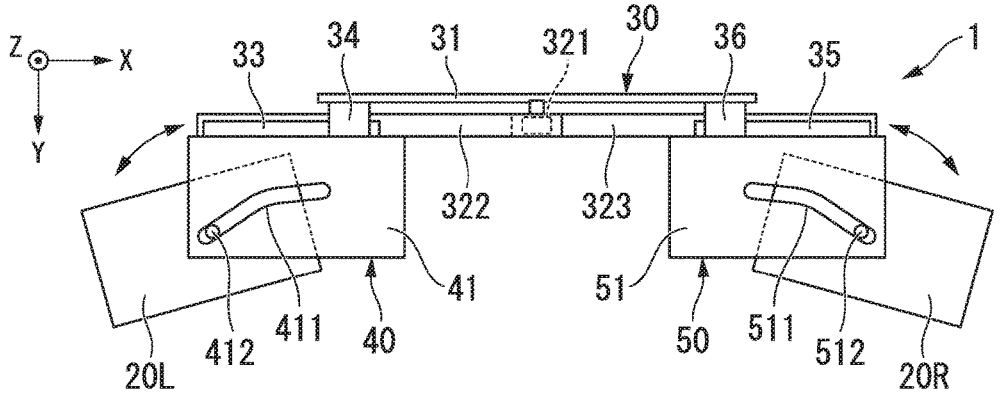
FIG. 3C is a diagram illustrating the example of the separation mechanism and the rotation mechanism in the first embodiment.

FIGS. 3A to 3C are views illustrating an example of the separation mechanism 30 and the rotation mechanism (40, 50) in the embodiment.

FIG. 3A is a view of the loudspeaker units (20L, 20R) after the electrical component unit 10 is separated (detached) as seen from above (a Z-axis direction). FIG. 3A illustrates a state before the separation mechanism 30 separates the loudspeaker unit 20L and the loudspeaker unit 20R from each other and a state before the rotation mechanism (40, 50) changes an orientation of the loudspeaker unit 20L and the loudspeaker unit 20R.

As illustrated in FIG. 3A, the acoustic processing device 1 includes the rotation mechanism 40 that changes the orientation (the sound emission direction) of the loudspeaker unit 20L, and the rotation mechanism 50 that changes the orientation (the sound emission direction) of the loudspeaker unit 20.

The rotation mechanism 40 includes the upper plate 41 and the lower plate 42, and the upper plate 41 includes a guide groove 411 and a following pin 412.

The guide groove 411 (cam groove) is disposed on the upper plate 41, and the following pin 412 moves along the guide groove 411, thereby changing the orientation (the sound emission direction) of the loudspeaker unit 20L. Further, the following pin 412 (cam following pin) is disposed on the upper surface of the loudspeaker unit 20L and is configured to be movable in the guide groove 411. A guide groove and a following pin that are the same as the guide groove 411 and the following pin 412 are also disposed on the lower plate 42.

Further, the rotation mechanism 50 includes the upper plate 51 and the lower plate 52, and the upper plate 51 includes a guide groove 511 and a following pin 512.

The guide groove 511 (cam groove) is disposed on the upper plate 51, and the following pin 512 moves along the guide groove 511, thereby changing the orientation (the sound emission direction) of the loudspeaker unit 20R. Further, the following pin 512 (cam following pin) is disposed on the upper surface of the loudspeaker unit 20R and is configured to be movable in the guide groove 511. A guide groove and a following pin that are the same as the guide groove 511 and the following pin 512 are also disposed on the lower plate 52.

Further, FIG. 3B illustrates an example of a state in which the separation mechanism 30 separates the loudspeaker unit 20L and the loudspeaker unit 20R from each other. In FIG. 3B, as the pinion portion 321 of the rack and pinion mechanism 32 rotates, the rack portion 322 moves and the support member 34 moves along the guide rail 33. Accordingly, the loudspeaker unit 20L moves to the left.

Further, as the pinion portion 321 rotates, the rack portion 323 moves and the support member 36 moves along the guide rail 35. Accordingly, the loudspeaker unit 20R moves to the right. Here, a moving distance of the loudspeaker unit 20L and a moving distance of the loudspeaker unit 20R are the same due to the rack and pinion mechanism 32.

Thus, in the embodiment, the separation mechanism 30 can move a relative distance between the loudspeaker unit 20L and the loudspeaker unit 20R.

Further, FIG. 3C illustrates an example of a state in which the separation mechanism 30 separates the loudspeaker unit 20L and the loudspeaker unit 20R from each other, and a state in which the rotation mechanism (40, 50) changes the orientation of the loudspeaker unit 20 (20L, 20R).

As illustrated in FIG. 3C, by moving the following pin 412 along the guide groove 411 of the rotation mechanism 40, the orientation of the loudspeaker unit 20L is changed. Further, by moving the following pin 512 along the guide groove 511 of the rotation mechanism 50, the orientation of the loudspeaker unit 20R is changed.

Next, an operation of connecting the acoustic processing device 1 according to the embodiment to the guitar 2 and outputting a sound of the guitar 2 will be described. First, an operation when a sound is output from the loudspeaker unit 20 of the acoustic processing device 1 will be described.

First, the input unit 12 receives the sound signal of the guitar 2, converts the sound signal into sound data which is a digital signal, and outputs the sound data to the acoustic processing unit 13. The acoustic processing unit 13 executes the acoustic processing on the basis of the setting information acquired from the operation unit 11 and outputs the sound data subjected to the acoustic processing to the communication unit 14.

Next, the communication unit 14 transmits the sound data output from the acoustic processing unit 13 to the communication unit 21 of the loudspeaker unit 20 through wireless communication. The communication unit 21 outputs the received sound data to the amplification unit 22. The amplification unit 22 amplifies the sound based on the sound data received by the communication unit 21 and outputs resultant sound to the loudspeaker 23. The operation of the loudspeaker unit 20L and the operation of the loudspeaker unit 20R are the same except that the sound data is different between a left channel and a right channel.

Thus, in the acoustic processing device 1, the sound of the guitar 2 is subjected to acoustic processing by the acoustic processing unit 13 of the electrical component unit 10 and output from the loudspeaker unit 20.

Next, an operation when the electrical component unit 10 of the acoustic processing device 1 according to the embodiment is used alone and the sound of the guitar 2 is output from an external loudspeaker device (not illustrated) will be described.

In such a case, the acoustic processing unit 13 of the electrical component unit 10 executes acoustic processing on the basis of the setting information acquired from the operation unit 11 and outputs the sound data subjected to the acoustic processing to the output unit 15. The output unit 15 outputs the sound data to the loudspeaker device line-connected to the output unit 15 to cause the loudspeaker device to output the sound of the guitar 2 subjected to the acoustic processing by the acoustic processing unit 13.

Thus, in the acoustic processing device 1, it is possible to use the electrical component unit 10 alone, and it is possible to acoustically process the sound of the guitar 2 using the acoustic processing unit 13 of the electrical component unit 10 and cause the sound of the guitar 2 to be output from an external loudspeaker device via the output unit 15.

Note that the acoustic processing unit 13 may perform the acoustic processing on the basis of the setting information stored in the storage unit 16. Further, the acoustic processing unit 13 may store the setting information set by the operation unit 11 in the storage unit 16 on the basis of an instruction from the operation unit 11.

As described above, the acoustic processing device 1 according to the embodiment includes the acoustic processing unit 13, the plurality of (for example, two) loudspeaker units 20, and the separation mechanism 30. The acoustic processing unit 13 executes the acoustic processing for the input sound data. The plurality of loudspeaker units 20 output the sound based on the sound data for which the acoustic processing unit 13 has executed the acoustic processing. The separation mechanism 30 is configured to be able to move the positions of the plurality of loudspeaker units 20 (relative positions with respect to the other loudspeaker units 20) and separates the plurality of loudspeaker units 20.

Accordingly, since the acoustic processing device 1 according to the embodiment can move the relative positions of the plurality of loudspeaker units 20, it is possible to increase the distance between the plurality of loudspeaker units 20. Therefore, the acoustic processing device 1 according to the embodiment can suitably obtain a sensation of sound localization and a spread of a sound field.

Further, in the embodiment, the separation mechanism 30 includes the support member 34 (36) that supports the loudspeaker unit 20, and the guide rail 33 (35) that moves the support member 34 (36) along the shape of the rail (the guide rail 33 (35)).

Thus, in the acoustic processing device 1 according to the embodiment, it is possible to appropriately move the relative positions of the plurality of loudspeaker units 20 with a simple configuration.

Further, in the embodiment, the separation mechanism 30 includes the rack-and-pinion mechanism 32 that uniformly moves the plurality of loudspeaker units 20.

Thus, in the acoustic processing device 1 according to the embodiment, it is possible to suitably obtain a spread of the sound field without impairing the sensation of sound localization.

Further, the acoustic processing device 1 according to the embodiment includes the rotation mechanism (40, 50) capable of changing the orientation (the sound emission direction) of the loudspeaker unit 20.

Thus, in the acoustic processing device 1 according to the embodiment, since the orientation of the loudspeaker units 20 can be changed, it is possible to increase a degree of freedom of the layout of the loudspeaker units 20 and to further suitably obtain a sensation of sound localization and a spread of the sound field.

Further, the acoustic processing device 1 according to the embodiment includes the electrical component unit 10 including the acoustic processing unit 13, the output unit 15 that outputs the sound data for which the acoustic processing unit 13 has executed the acoustic processing, and the operation unit 11 that operates the acoustic processing unit 13. The electrical component unit 10 is configured to be detachable.

That is, the acoustic processing device 1 according to the embodiment includes an electrical component unit 10 including the acoustic processing unit 13 that executes the acoustic processing for the input sound data, the output unit 15 that outputs the sound data for which the acoustic processing unit 13 has executed the acoustic processing, and the operation unit 11 that operates the acoustic processing unit 13 and configured to be detachable, and the plurality of loudspeaker units 20 that output a sound based on the sound data for which the acoustic processing unit 13 has executed the acoustic processing.

Thus, in the acoustic processing device 1 according to the embodiment, it is possible to use the electrical component unit 10 alone and to use the electrical component unit 10, for example, as a small component amplifier. Therefore, in the acoustic processing device 1 according to the embodiment, it is possible to improve the convenience.

Further, for example, the user can bring the electrical component unit 10 to a studio or the like, and the sound of the guitar 2 can be subjected to acoustic processing by the electrical component unit 10 and output to a loudspeaker installed in the studio.

In this case, the user can create a favorite tone with an operation feeling of the electrical component unit 10 familiar from a usual situation and cause the created tone to be easily reproduced by storing the setting information in the storage unit 16. As described above, in the acoustic processing device 1 according to the embodiment, it is possible to improve the convenience since the electrical component unit 10 is configured to be detachable.

Further, since the electrical component unit 10 and the loudspeaker unit 20 can be separated and used, the user can place the electrical component unit 10 in his or her hand and cause the sound to be output from the loudspeaker unit 20 at a position away from the user while operating the electrical component unit 10, thereby improving the convenience.

Second Embodiment

Next, the acoustic processing device 1*a* according to a second embodiment will be described with reference to the drawings.

In this embodiment, an example in which the loudspeaker unit 20*a* is configured to be detachable will be described.

Figure 4A:
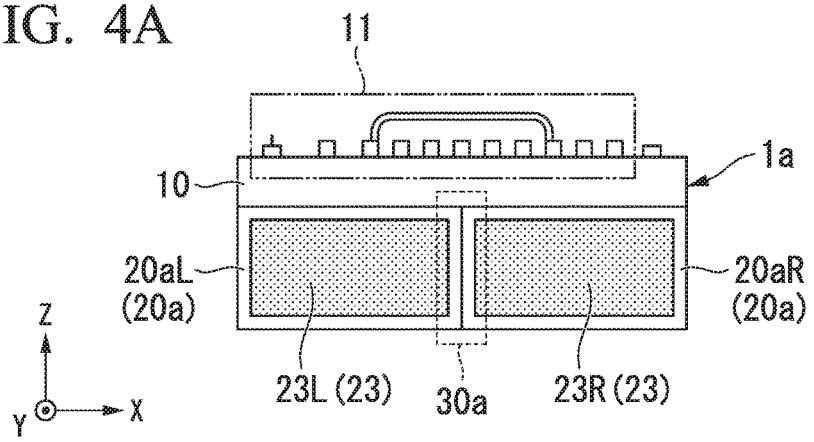
FIG. 4A is a configuration diagram illustrating an example of an acoustic processing device according to a second embodiment.
Figure 4B:
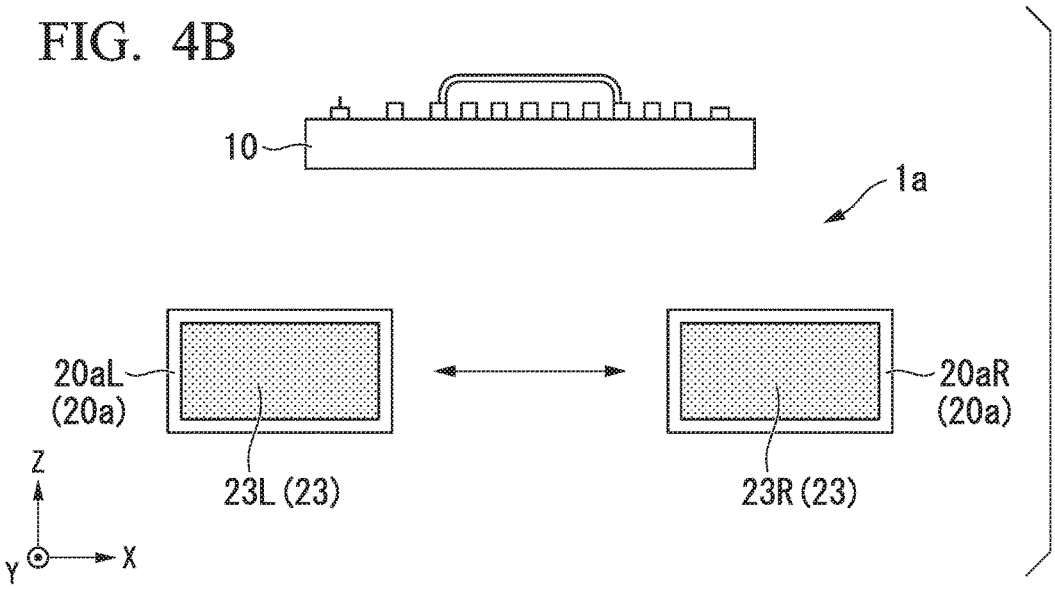
FIG. 4B is a configuration diagram illustrating the example of the acoustic processing device according to the second embodiment.

FIGS. 4A and 4B are configuration diagrams illustrating an example of the acoustic processing device 1*a* according to the embodiment.

As illustrated in FIGS. 4 and 4B, the acoustic processing device 1*a* includes an electrical component unit 10, two loudspeaker units 20*a* (20*a*L, 20*a*R), and a separation mechanism 30*a*.

Note that, in FIGS. 4A and 4B, components the same as those in FIG. 1 described above are denoted with the same reference numerals, and description thereof is omitted. Further, the loudspeaker unit 20*a*L and the loudspeaker unit 20*a*R will be described as a loudspeaker unit 20*a* when an arbitrary loudspeaker unit included in the acoustic processing device 1*a* is indicated or when the loudspeaker unit 20*a*L and the loudspeaker unit 20*a*R are not being particularly distinguished.

FIG. 4A illustrates an external view of the acoustic processing device 1*a* when the electrical component unit 10 and the loudspeaker units 20*a* (20*a*L, 20*a*R) are not separated from each other. Since an appearance of the acoustic processing device 1*a* when the electrical component unit 10 and the loudspeaker units 20*a* (20*a*L, 20*a*R) are not separated from each other is the same as that in the first embodiment illustrated in FIG. 1A, description thereof will be omitted herein.

Further, FIG. 4B illustrates a configuration example of the acoustic processing device 1*a* when the electrical component unit 10, the loudspeaker unit 20*a*L, and the loudspeaker unit 20*a*R are separated from each other.

As illustrated in FIG. 4B, the loudspeaker unit 20*a* in the embodiment is configured to be detachable. The loudspeaker unit 20*a* can be freely disposed in any position.

Next, details and an operation of the separation mechanism 30*a* according to the embodiment will be described with reference to FIGS. 5A and 5B.

Figure 5A:
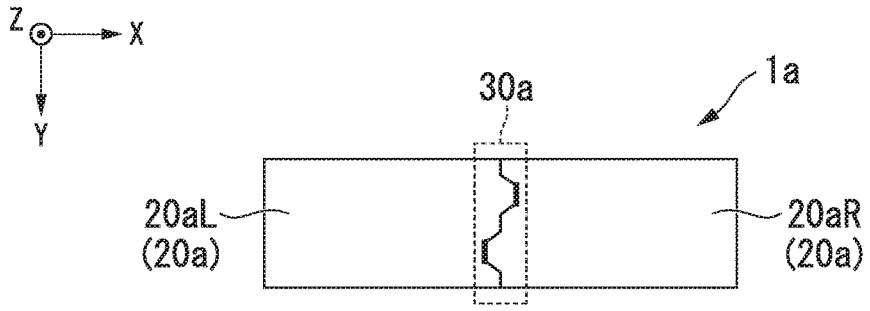
FIG. 5A is a diagram illustrating an example of a separation mechanism in the second embodiment.
Figure 5B:
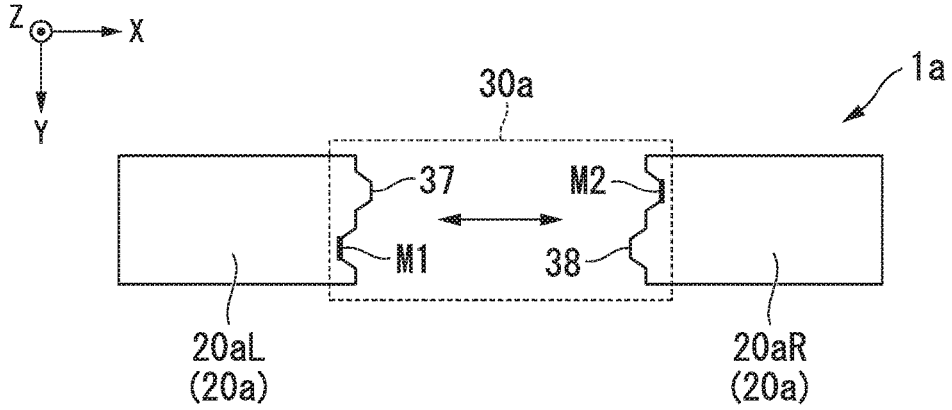
FIG. 5B is a diagram illustrating the example of the separation mechanism in the second embodiment.

FIGS. 5A and 5B are views illustrating an example of the separation mechanism 30*a* in the embodiment.

FIG. 5A is a diagram of the loudspeaker units (20*a*L, 20*a*R) after the electrical component unit 10 is separated therefrom (after the electrical component unit 10 is detached) as viewed from above (a Z-axis direction). FIG. 5A illustrates a state before the separation mechanism 30*a* separates the loudspeaker unit 20*a*L and the loudspeaker unit 20*a*R from each other.

Further, FIG. 5B illustrates a state in which the separation mechanism 30*a* separates the loudspeaker unit 20*a*L and the loudspeaker unit 20*a*R from each other.

As illustrated in FIGS. 5A and 5B, the separation mechanism 30*a* includes a positioning boss 37 and a magnet M1 on a connection surface of the loudspeaker unit 20*a*L, and a positioning boss 38 and a magnet M2 on a connection surface of the loudspeaker unit 20*a*R. Here, the connection surface indicates a connection surface between the loudspeaker unit 20*a*L and the loudspeaker unit 20*a*R.

The positioning boss 37 is a convex portion with a guide and is formed to coincide with a concave portion formed in an opposing portion in the connection surface of the loudspeaker unit 20*a*R. Further, the positioning boss 37 fixes the loudspeaker unit 20*a*L and the loudspeaker unit 20*a*R using the magnet M2 provided in the opposing concave portion.

Further, the positioning boss 38 is a convex portion with a guide and is formed to coincide with a concave portion formed in an opposing portion in the connection surface of the loudspeaker unit 20*a*L. Further, the positioning boss 38 fixes the loudspeaker unit 20*a*L and the loudspeaker unit 20*a*R using the magnet M1 provided in the opposing concave portion.

Thus, the loudspeaker unit 20*a*L and the loudspeaker unit 20*a*R are configured to be detachable using the separation mechanism 30*a*, and the loudspeaker unit 20*a*L and the loudspeaker unit 20*a*R can be freely disposed. That is, for example, the loudspeaker unit 20*a*L and the loudspeaker unit 20*a*R that have been separated can be freely disposed at any distance or the orientations thereof can be changed, and the loudspeaker unit 20*a*L and the loudspeaker unit 20*a*R can be horizontally disposed.

Further, since a functional block diagram of the acoustic processing device 1*a* according to the embodiment is the same as that of the acoustic processing device 1 illustrated in FIG. 2 described above, description thereof will be omitted herein. In the acoustic processing device 1*a* according to the embodiment, the loudspeaker unit 20L and the loudspeaker unit 20R are replaced with the loudspeaker unit 20*a*L and the loudspeaker unit 20*a*R having the same functional blocks, but functional block diagrams thereof are the same.

As described above, the acoustic processing device 1*a* according to the embodiment is configured to be able to move relative positions of a plurality of (for example, two) loudspeaker units 20*a*, and includes a separation mechanism 30*a* that separates the plurality of loudspeaker units 20*a*.

Accordingly, the acoustic processing device 1*a* according to the embodiment achieves the same effects as those of the first embodiment, and it is possible to suitably obtain a sensation of sound localization and a spread of a sound field.

Further, in the separation mechanism 30*a* of the embodiment, the two loudspeaker units 20*a* are configured to be detachable.

Accordingly, in the acoustic processing device 1*a* according to the embodiment, the loudspeaker unit 20*a* can be used freely in any disposition and direction, and it is possible to obtain a sensation of localization preferred by the user. Therefore, in the acoustic processing device 1*a* according to the embodiment, it is possible to more suitably obtain a sensation of sound localization and a spread of a sound field. Further, in the acoustic processing device 1*a* according to the embodiment, since it is possible to increase a degree of freedom of the layout of the loudspeaker units 20*a*, it is possible to improve the convenience.

Note that the present invention is not limited to the above embodiments and can be changed without departing from the gist of the present invention.

For example, in each of the above embodiments, the example in which the acoustic processing device 1 (1*a*) is, for example, a guitar amplifier loudspeaker using the sound of the guitar 2 as a sound source has been described, but the present invention is not limited thereto. The acoustic processing device 1 (1*a*) may be a device using another musical instrument or device as the sound source, or may be any other processing device as long as the device is a device including the electrical component unit 10 and the loudspeaker unit 20 (20*a*).

Further, although the example in which wireless communication is used when the sound data is transmitted from the electrical component unit 10 to the loudspeaker unit 20 (20*a*) has been described in each of the above-described embodiments, the sound data may be transmitted by a wire. Further, the wireless communication scheme is not limited to the above-described scheme, and wireless communication of other schemes may be used.

Further, in each of the above embodiments, the example in which the two loudspeaker units 20 (20*a*) are separated from each other has been described as an example in which the plurality of loudspeaker units 20 (20*a*) are separated from one another, but the present invention is not limited to this example. For example, the acoustic processing device 1 (1*a*) may include three or more loudspeaker units 20 (20*a*) so that the respective loudspeaker units 20 (20*a*) can be separated from one another.

In the above embodiment, the separation mechanism 30 (30*a*) has been described as an example of a configuration in which the relative positions of the plurality of loudspeaker units are movable, but the present invention is not limited to thereto. For example, in the first embodiment, the separation mechanism 30 may be configured such that the loudspeaker unit 20L and the loudspeaker unit 20R are detachable from the upper plate (41, 51) and the lower plate (42, 52). Further, although the example in which the rack and pinion mechanism 32 and the guide rails (33, 35) are disposed on the back panel 31 has been described, the rack and pinion mechanism 32 and the guide rails (33, 35) may be disposed under the lower plates (42, 52).

Further, in this case, a rotation mechanism may be provided in the support member (34, 36) so that the direction of the loudspeaker unit 20 can be changed. Further, in the rotation mechanism, the angle may be fixed using a ratchet mechanism or the like.

Further, although the example in which the direction of the loudspeaker unit 20 is rotated in a horizontal direction (the X-axis direction) in the above-described rotation mechanism (40, 50) has been described, a structure in which the direction of the loudspeaker unit 20 is rotated in a vertical direction (Z-direction) may be adopted. For example, the rotation mechanism (40, 50) may include a side plate so that the loudspeaker unit 20 is supported by the side plate and the direction of the loudspeaker unit 20 can be changed in the vertical direction by the guide groove and the following pin.

Further, in the first embodiment, the separation mechanism 30 may not include the rotation mechanism (40, 50).

Further, in the first embodiment, the number of sets of the guide rails (33, 35) and the support members (34, 36) is not limited to two, and may be three or more. Further, the guide rails (33, 35) may be disposed in the vertical direction (the Z-axis direction) so that the loudspeaker unit 20 can be moved in the vertical direction.

Further, in the first embodiment, the example in which the guide rails (33, 35) are linear rails has been described, but the present invention is not limited thereto. For example, the guide rails (33, 35) may have a shape such that the support members (34, 36) are moved along other curved paths (a predetermined path) such as a fan shape (an arc shape).

In each of the above-described embodiments, the example in which the shape of the acoustic processing device 1 (1*a*) is a rectangular parallelepiped has been described, but the present invention is not limited thereto. For example, the acoustic processing device 1 (1*a*) may have a shape having a curved shape such as a fan shape. In such a case, the acoustic processing device 1 (1*a*) may include the guide rails (33, 35) that move the support members (34, 36) along the above-described curved path (the predetermined path).

Further, in each of the above embodiments, the acoustic processing of the acoustic processing unit 13 is not limited to the processing described in the embodiment, and other acoustic processing may be performed.

Further, although the example in which the amplification unit 22 is an amplifier with a DAC has been described in each of the above embodiments, the amplification unit 22 may be an amplifier that does not include a DAC. Further, in this case, a DAC function may be included in the acoustic processing unit 13 or the communication unit 21.

The acoustic processing device 1 (1*a*) described above has a computer system included therein. Each processing step of the acoustic processing device 1 (1*a*) described above is stored in the form of a program in a computer-readable recording medium, and the process is performed by the computer reading and executing this program. Here, the computer-readable recording medium refers to a magnetic disk, a magneto-optical disc, a CD-ROM, a DVD-ROM, a semiconductor memory, or the like. Further, a computer program thereof may be distributed to a computer through a communication line, and a computer receiving this distribution may execute the program.

While the embodiments of the invention have been described and illustrated above, the present invention is not limited to the above embodiments. Various modifications can be made without departing from the scope of the present invention.

What is claimed is:

1. An acoustic processing device comprising:

a plurality of loudspeaker units configured to output sound; and a mechanism configured to attach or detach the plurality of loudspeaker units, the mechanism including:

a first positioning boss and a first magnet provided on a connection surface of a first loudspeaker unit of the plurality of loudspeaker units; and a second positioning boss and a second magnet provided on a connection surface of a second loudspeaker unit of the plurality of loudspeaker units, wherein the first positioning boss is configured to contact the second magnet and the second positioning boss is configured to contact the first magnet to attach the first loudspeaker unit to the second loudspeaker unit.

2. The acoustic processing device according to claim 1, wherein the mechanism further includes:

a support member configured to support at least one loudspeaker unit of the plurality of loudspeaker units; and a guide rail configured to guide a movement of the support member.

3. The acoustic processing device according to claim 2, wherein the guide rail has a shape that extends in a predetermined direction, and wherein the guide rail is configured to support a movement of the support member along the predetermined direction.

4. The acoustic processing device according to claim 2, further comprising:

a rotation mechanism configured to change an orientation of at least one loudspeaker unit of the plurality of loudspeaker units.

5. The acoustic processing device according to claim 1, further comprising:

an acoustic processing unit configured to execute acoustic processing on input sound data, wherein the plurality of loudspeaker units is configured to output sound generated based on the sound data on which the acoustic processing is executed.

6. The acoustic processing device according to claim 5, wherein the plurality of loudspeaker units are detachable from the acoustic processing unit.

7. The acoustic processing device according to claim 1, further comprising:

an electrical component unit including the acoustic processing unit, an output unit, and an operation unit, the acoustic processing unit executing acoustic processing on the input sound data, the output unit outputting the sound data on which the acoustic processing is performed to the plurality of loudspeaker units, the operation unit receiving an operation on the acoustic processing unit, wherein the electrical component unit is configured to be detachable from the plurality of loudspeaker units.

8. The acoustic processing device according to claim 1, further comprising:

an acoustic processing unit configured to execute acoustic processing on input sound data; and an output terminal configured to output, to an external device, the sound data on which the acoustic processing is executed.

* * * * *